US005131818A

United States Patent [19]

Wittkop et al.

[11] Patent Number: 5,131,818

[45] Date of Patent: Jul. 21, 1992

[54] HIGH-PRESSURE WATER PUMP HAVING A POLYETHERETHERKETONE CYLINDER BUSHING FOR PURE WATER

[75] Inventors: Wolfram Wittkop, Sprockhövel; Ulrich Samland, Hattingen, both of Fed. Rep. of Germany

[73] Assignee: Hauhinco Maschinenfabrik G. Hausherr, Jochums GmbH & Co. KG, Sprockhovel, Fed. Rep. of Germany

[21] Appl. No.: 717,220

[22] Filed: Jun. 18, 1991

[30] Foreign Application Priority Data

May 7, 1991 [EP] European Pat. Off. ..... 91 107357.5

[51] Int. Cl.[5] ..... F04B 21/08

[52] U.S. Cl. ..... 417/273; 92/170.1; 417/DIG. 1

[58] Field of Search ..... 417/DIG. 1, 273, 571; 92/170.1

[56] References Cited

U.S. PATENT DOCUMENTS

| | | | |
|---|---|---|---|
| 3,288,079 | 11/1966 | Kling | 92/170.1 X |
| 3,667,868 | 6/1972 | Brunner | 417/273 |
| 4,846,631 | 7/1989 | Parrott | 417/273 |
| 4,913,628 | 4/1990 | Samland et al. | 417/273 |

FOREIGN PATENT DOCUMENTS

| | | | |
|---|---|---|---|
| 125979 | 5/1990 | Japan | 417/DIG. 1 |

*Primary Examiner*—Leonard E. Smith
*Attorney, Agent, or Firm*—Herbert Dubno

[57] ABSTRACT

A high-pressure water pump of the reciprocating piston type has its metal piston reciprocatable in a cylinder bushing composed of PEEK base high-strength thermoplastic synthetic resin and constructed so as to define a cooling clearance between the piston and the cylinder designed to prevent the temperature of the bushing on continuous operation from rising above 100° C. The piston shoe and the slide bearing for the eccentric shaft should also be a PEEK based resin which can have a filler of carbon fibers, PTFE, glass fibers and/or mineral.

17 Claims, 4 Drawing Sheets

HIGH-PRESSURE WATER PUMP HAVING A POLYETHERETHERKETONE CYLINDER BUSHING FOR PURE WATER

FIELD OF THE INVENTION

Our present invention relates to a high-pressure water pump and, more particularly, to a high-pressure water pump of the type in which a metallic piston is reciprocated in a cylinder by an eccentric on an eccentric shaft journaled in the cylinder housing and of the type in which the water is drawn into the pump through an inlet to an eccentric chamber in which the eccentric is rotated, is supplied from the chamber to the cylinder compartment between the piston and the cylinder head, and is displaced past a discharge valve to an outlet port on the housing.

BACKGROUND OF THE INVENTION

High-pressure water pumps which utilize piston and cylinder arrangements are known and the type of high-pressure water pump with which the present invention is concerned comprises at least one cylinder, a cylinder bushing or sleeve within this cylinder, a cylinder head, a metal piston reciprocatable in the cylinder bushing and a piston shoe on the piston and engageable with an eccentric carried by an eccentric shaft journaled in an eccentric shaft housing.

The pump further comprises intake and outlet valves with valve closure members and the piston guide shoe operatively connects the piston with the eccentric so that upon rotation of the eccentric shaft, the eccentric will reciprocate the piston to alternately expand and contract the cylinder compartment or chamber defined between the piston and the cylinder head in the cylinder bushing During an intake stroke, corresponding to expansion of the cylinder chamber, a low pressure is developed in the cylinder chamber and water is drawn from the eccentric shaft compartment into the cylinder chamber During the succeeding stroke, namely the discharge stroke, the volume of the cylinder chamber is contracted and the water is forced under high pressure from the cylinder chamber.

To supply the water, a low-pressure reservoir is generally provided and can be connected to the housing by an appropriate flange communicating between the eccentric shaft compartment and the low-pressure water reservoir. For the purposes of this application, low pressure means a water pressure of 10 bar or less. The water is drawn out of the eccentric shaft compartment via at least one intake valve during the intake stroke into the cylinder chamber. The intake valve opens when the water pressure in the cylinder chamber is below the low pressure of the reservoir by a predetermined low-pressure threshold.

If the pressure difference is smaller than the low pressure threshold or with an opposite sign, the suction valve is closed.

During the displacement stroke, the water in the cylinder chamber is compressed at high pressure. For the purposes of this application, the term high pressure means a water pressure of, for example, 60 bar to 450 bar.

The outlet valve opens as a rule at a selectable high-pressure threshold of the water pressure, which corresponds to the desired minimum high-pressure level. Below this high-pressure threshold, the outlet valve is closed. Upon exceeding the high-pressure threshold during the displacement stroke, the outlet valve opens to permit the displaced water to flow to the outlet port of the housing under high pressure.

The kinematics of the piston movement is such that the piston has a so-called upper dead point and so-called lower dead point The stroke of the piston is established by the rotation of the eccentric which is coupled to the piston by the piston guide shoe which pushes the piston toward the upper dead point position or allows the movement of the piston, e.g. under spring force, into the lower dead point position. A spring can therefore retain the shoe of the piston against the eccentric.

The piston can be guided, in its lower dead point position, over its entire length in the cylinder bushing or can have a portion of the piston turned toward the eccentric shaft which is withdrawn from the cylinder bushing in its lower dead point position. If the piston and cylinder bushing are of the same length, the piston in its lower dead point position is guided in the cylinder bushing over a length which is equal about to the difference between the length of the cylinder bushing and the piston stroke. In any event, the piston and cylinder bushing should be dimensioned with respect to their lengths and the stroke such that detrimental canting of the piston does not occur in operation.

In high-pressure pumps of the aforedescribed type provided heretofore, both the piston and the cylinder bushing were composed of metallic materials. A clearance was frequently defined between the piston and cylinder bushing which would allow sliding of the piston in the cylinder bushing at the operating temperature range. In other words at the operating temperature, with thermal expansion, the tolerance was such that the piston was not permitted to seize in the cylinder. The length over which the piston is guided in the cylinder could be defined as the gap length.

In high-pressure water pumps, the water which is displaced has functional significance for the operation of the pump. On the one hand, the high-pressure pump is continuously cooled by the water flow through it. On the other hand, the displaced water also performed a lubricating function since it generally carried a lubricant along with it. Free slidable surfaces of the pump were continuously wetted with the lubricant carried by the water. Indeed, lubricant content of the water could be as much as 5%, although lesser lubricant contents could be used.

When both the piston and the cylinder bushing were composed of metal, a minimum lubrication was essential. Should the supply of lubricant to these surfaces be reduced below the necessary minimum, the temperature of the cylinder bushing and the piston would rise because of increased friction and in spite of the above-mentioned cooling effect. With increased friction, there was increased wear of material from the piston and/or the bushing which resulted in increasing detriment to the function of the high-pressure water pump. In practice it was found that the conventional high-pressure water pumps, operated without the addition of lubricant to the water, had a relatively short life and rapidly deteriorated for the reasons given above. However, the lubricants used were detrimental to the environment if the displaced water was not conducted in a closed path.

In most cases in which high-pressure water is used, a closed path for the water is impossible or, at best, is extremely expensive. In other words, lubricant addition is undesirable on environmental grounds but is a practical necessity on technological grounds for effective operation of the high-pressure water pump.

OBJECTS OF THE INVENTION

It is, therefore, the principal object of the present invention to provide a high-pressure water pump of the type generally described above but which has an improved useful life even with continuous operation and which can be operated without the addition of lubricants to the water, i.e. for the displacement of pure water if desired.

Another object of this invention is to provide an improved high-pressure pump which avoids the drawbacks of earlier systems.

SUMMARY OF THE INVENTION

These objects and others which will become apparent hereinafter are attained, in accordance with the invention, by providing the cylinder bushing of a material selected from the group of high-strength thermoplastic synthetic resins on a polyetheretherketone basis, and further such that the all-around clearance or gap between the piston and the cylinder bushing is dimensioned to form a cooling gap through which a portion of the displaced water is forced as a cooling medium The gap is dimensioned so that this by-passed portion of the flow serving as the cooling medium for the gap, in continuous operation of the pump prevents the temperature of the cylinder bushing from exceeding 100° C. and most preferably, from exceeding 50° C.

More particularly, the high-pressure water pump of the invention can comprise:

- a housing defining an eccentric-shaft compartment, a cylinder and a cylinder head;
- an eccentric shaft journaled in the housing and having an eccentric in the compartment;
- a cylinder bushing composed of a high-strength polyetheretherketone thermoplastic synthetic resin in the cylinder;
- a metal piston slidable in the cylinder bushing;
- a piston-displacement shoe operatively connected to the piston and engaging the eccentric whereby the piston is reciprocated in the cylinder bushing upon rotation of the eccentric shaft; and
- intake and outlet valves enabling water to be drawn in an intake stroke of the piston into a cylinder chamber defined in the bushing between the head and the piston from the compartment and water to be driven from the pump at high pressure from the cylinder chamber in a discharge stroke of the piston, the piston defining an all-around clearance with the cylinder bushing through which a portion of water driven from the chamber is forced as a cooling medium, the all-around clearance having a gap width selected to define a minimum volume rate of flow of the cooling medium sufficient to maintain a maximum temperature of the cylinder bushing of 100° C. in continuous operation.

When we refer to practically lubricant-free water herein, we mean that the water that is displaced need not have lubricants added to it for the purposes of lubricating the pump. Slight contamination of the water can occur, for example, via units provided upstream of the high-pressure water pump and which cannot be avoided.

Nevertheless the pump permits water with a high degree of purity to be displaced and it permits the system to be used for monitoring purity of water if desired or in conjunction with a system for monitoring the purity of the water.

The invention is based upon the recognition from tribology that two metallic workpieces sliding relative to one another tend toward cold welding when their surfaces are devoid of lubricant.

Cold welding can be avoided when one of the two materials is a nonmetallic material. Most nonmetallic materials, because of their characteristics like hardness, elasticity and especially thermal conductivity, are not satisfactory for many machine construction purposes.

Surprisingly, however, we have found that the combination of metal with a high-strength thermoplastic polyetheretherketone based synthetic resin for the piston and cylinder bushing allows continuous operation in a lubricant-free manner in the high-pressure pump when the clearance, tolerance or gap is provided as a coolant flow gap through with a portion of the displaced water can flow as a cooling medium.

As a consequence, the advantages of the material pair in the tribological sense are utilized while the drawback of the low thermal conductivity of the nonmetallic body is overcome by augmenting the heat transfer by forcing a partial stream of water through the gap. High-strength thermoplastic materials of the polyetheretherketone type satisfy the mechanical requirements.

The cooling efficiency which is determined by the size of the clearance and thus the volume rate of flow of the water through it is a function of the pressure difference between the water pressure in the cylinder chamber and the water pressure in the eccentric shaft compartment, the width of the gap and the length of the gap.

The gap length is usually determined by structural considerations. The gap width, therefore, can be adjusted so that a maximum permitted temperature developed at the bushing is 100° C. In practice it turns out that the amount of high-pressure water which is by-passed as the cooling stream is so small that the pump function of the high-pressure pump is not detrimentally effected.

While the cylinder bushing can be composed of a high-strength thermoplastic synthetic resin of the polyetheretherketone (PEEK) type without a filler, in a preferred embodiment of the invention, the cylinder bushing is composed of the PEEK-containing carbon fibers as a filler. Carbon fibers form a reinforcement of the material in the structural sense and improve the mechanical properties. The thermal conductivity is increased by the presence of the carbon fibers as well, thereby permitting the partial flow of cooling water to pass through the cooling gap to be reduced or minimized. Carbon fibers also have a graphitic structure in a microscopic sense and thus the graphite simultaneously contributes lubricating characteristics to the bushing or sleeve.

The PEEK based high-strength thermoplastic synthetic resin can contain in addition or alternatively, polytetrafluoroethylene as a filler contributing lubricating properties. It is also possible to incorporate glass fibers or mineral fibers or both in the high-strength PEEK based material It should also be mentioned that with all embodiments, the high-strength thermoplastic PEEK based synthetic resin, with respect to its macroscopic properties, should have an isotropic appearance.

According to a further feature of the invention, the material of the bushing is a high-strength thermoplastic PEEK based synthetic resin with a hardness of at least 110 on the Rockwell "M" scale.

A higher hardness will reduce the rate of wear and ensure good dimensional stability of the cylinder bushing even with continued operation for length performance of time. The material of the bushing should have a thermal conductivity of at least 0.80 W/mK. Higher thermal conductivities reduce the volume rate of flow of the cooling medium which is required in the cooling gap to prevent the maximum temperature of the bushing to rising above 100° C.

It has been found to be advantageous, moreover, to provide the cylinder bushing with a roughness of $R_z$ less than 2.5 μm and $R_z$ greater than 1.5 /μm. The roughness $R_z$ is defined as the mean value of the depths of discrete points taken over 5 successive individual measurements using standard roughness measuring techniques. The low roughness corresponds to low friction and thus a lesser development of friction heat. A certain minimum value of the roughness cannot, however, be reduced since even pure water has some lubricating properties, although poor, and which are noticeable at the minimum roughness.

A minimum roughness provides pockets in the surface in which water can form more or less stationary cushions to permit the water itself to provide the lubricant effect. It has been found to be especially advantageous to cement the cylinder bushing in the cylinder.

For optimum results, the ratio of gap width to gap length should be in the range of 0.0005 to 0.0007, when the ratio of the by-passed cooling medium flow to the total pump intake is 0.0002 volume % to 0.0003 volume %.

It also has been found to be advantageous to provide the piston guide shoe of a high-strength thermoplastic PEEK base synthetic resin and to journal the eccentric shaft in slide bearing shells of this material and/or to provide this material as the material for the valve closure elements. The bearing shells can be formed in one piece as bushings or sleeves or they can be assembled from segments, i.e. multipartite shells. Of course, the materials used for the bearing shells, the valve members and the piston shoes can include fillers as described.

The high-pressure water pump of the invention can provide a plurality of cylinders in a row and the cylinders can be arrayed in a radial plane or in an axial plane. Other embodiments are conceivable as well in which a plurality of cylinders is provided although the pump can have a single cylinder if desired.

The high-pressure water pump can be used for a variety of purposes. For example, it can be used in subterranean coal mining operations utilizing pure water without detriments to continuous operation of the pump. The danger that environmentally hazardous substances, such as conventional lubricants for the water, is obviated and there is no danger that contaminants will be thus introduced into ground water.

The pump can be employed as a pressure pump for high-pressure water jet cleaning with the advantage that direct removal systems for the water run-off will not be additionally loaded. At the dirt separator, only dirt removed in the cleaning operation is captured and it is not necessary to remove in these systems significant quantities of lubricant additives. The high-pressure pump can also be used in scientific research and the like, for example as a pressure and displacement pump for high-pressure liquid chromatography units (HPLC). In such cases it is of critical importance to avoid introducing contaminants into the water. Of course other uses are possible wherever high-pressure water may be necessary.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
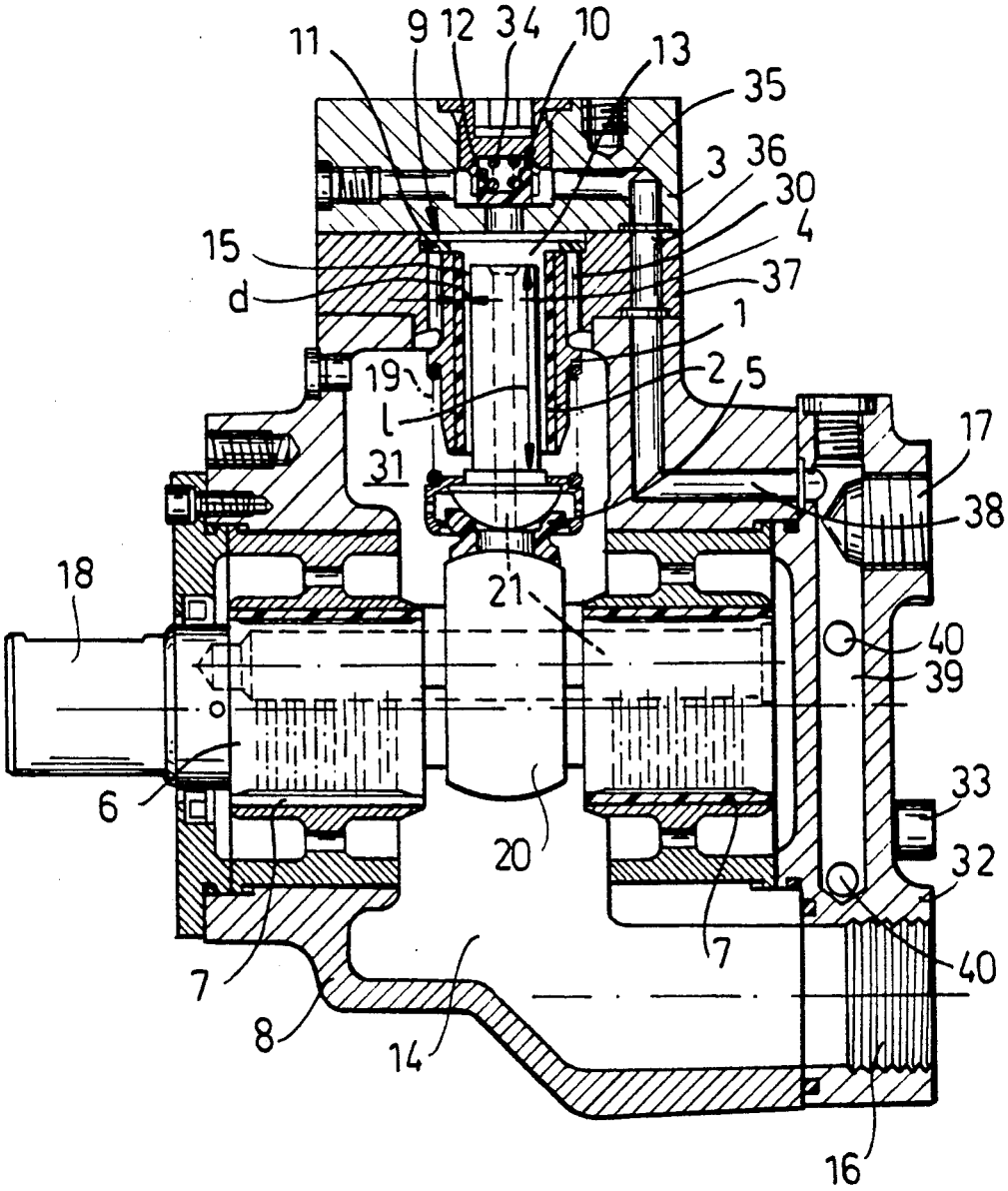
FIG. 1 is an axial sectional view through a high-pressure water pump according to the invention.
Figure 2:
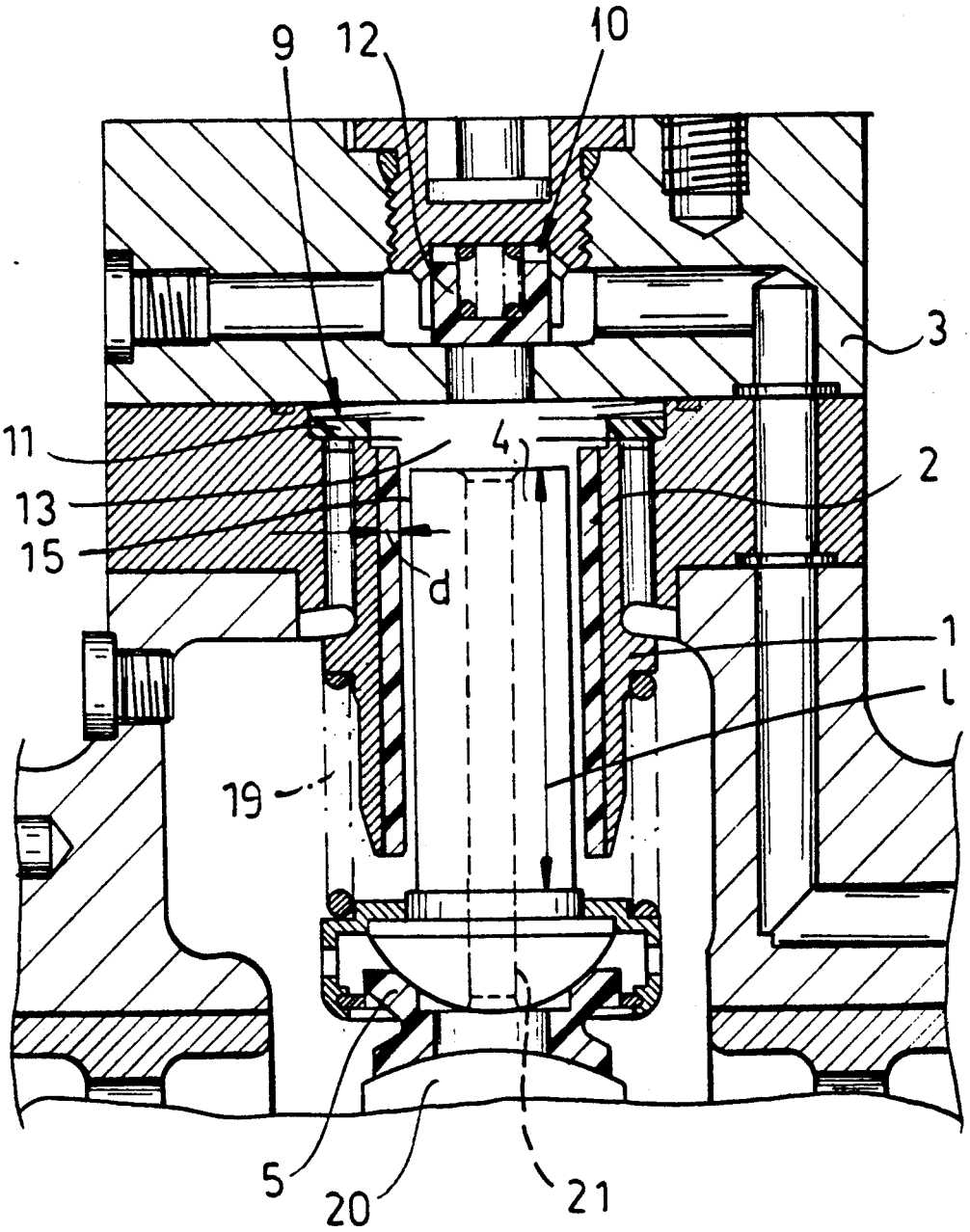
FIG. 2 is a detail view of the piston and cylinder bushing portions of this pump drawn to a larger scale.
Figure 4:
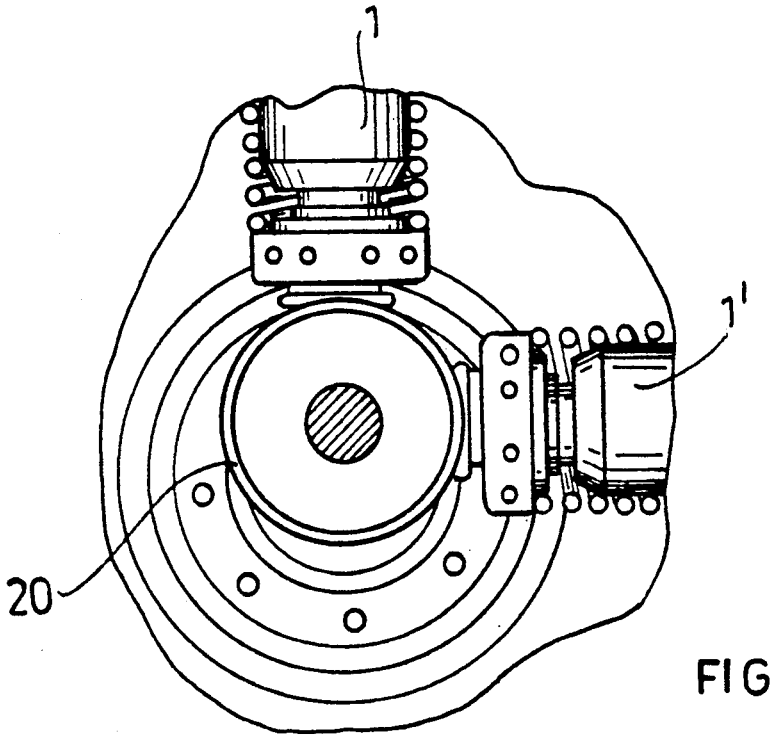
FIG. 4 is a radial cross section through a pump of the type shown in FIG. 1 and 2 having a plurality of angularly-spaced pistons driven by a single eccentric.
Figure 5:
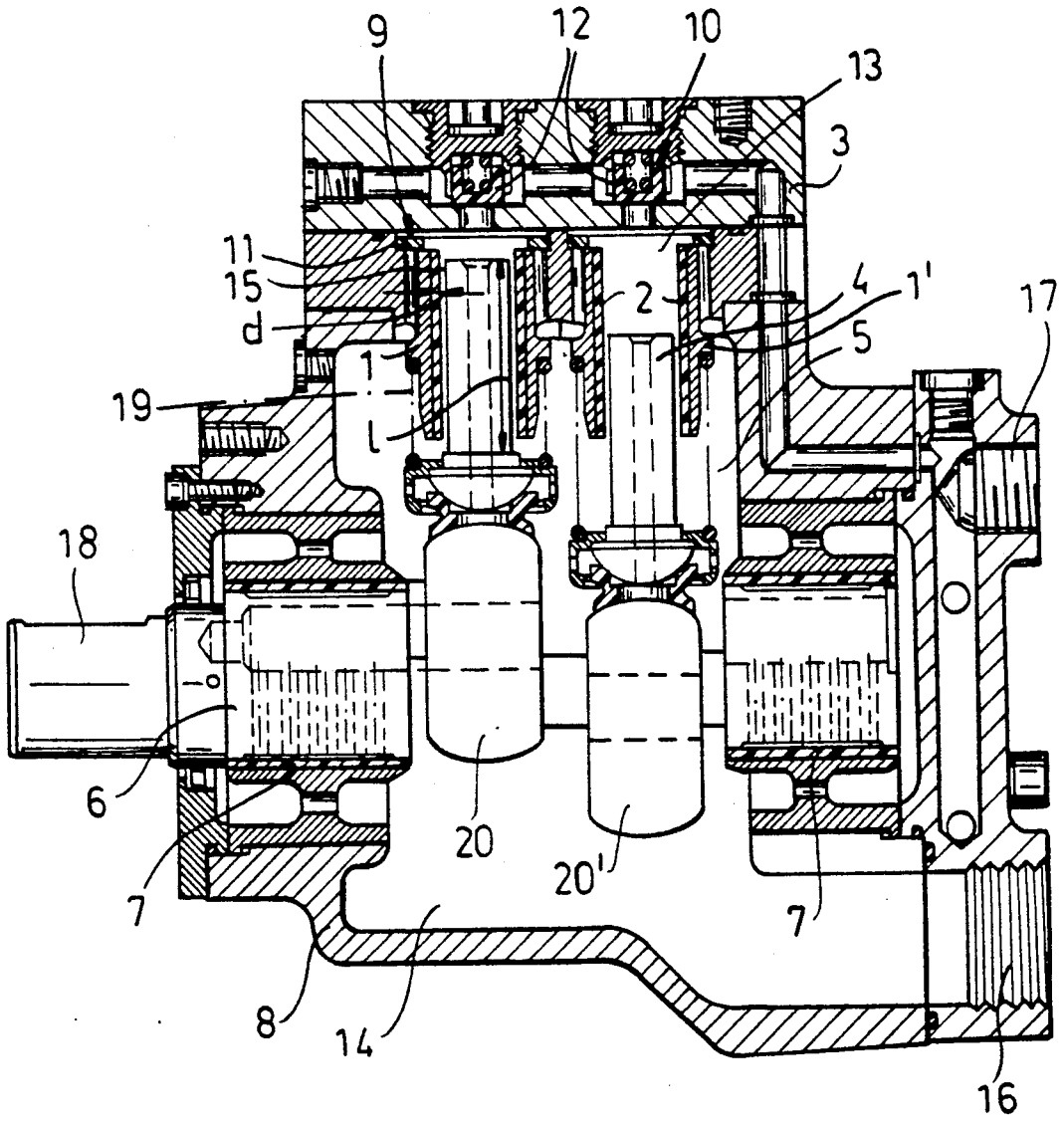
FIG. 5 is a cross sectional view similar to FIG. 1 showing a high-pressure water pump having a row of pistons or cylinders, the row lying in an axial plane.

The high-pressure water pump of the invention has been illustrated in the form of a radial piston pump in FIG. 1 and in FIG. 1, a single cylinder 1 has been illustrated, and in FIG. 4, two cylinders 1 and 1' are shown to be provided in angularly-spaced relationship about the eccentric shaft whose eccentric is represented at 20. In the embodiment of FIG. 5, the two cylinders 1 and 1' have been shown to be axially spaced apart and each cooperates with a respective eccentric 20 and 20' on the common eccentric shaft.

It will be apparent from FIGS. 4 and 5 that any number of cylinders can be angularly spaced in a common radial plane (FIG. 4) or axially spaced in a common axial plane (FIG. 5) or that various arrangements can be provided in which cylinders and respective pistons are both axially and angularly spaced from one another about the axis of the eccentric shaft. The same principles as will be developed below apply to all such arrangements.

As can be seen from FIG. 1, each cylinder 1 (or 1') can receive a cylinder bushing 2 which is composed of a material from the group of high-strength thermoplastic synthetic resin of a polyetheretherketone base, i.e. a PEEK resin.

Figure 3:
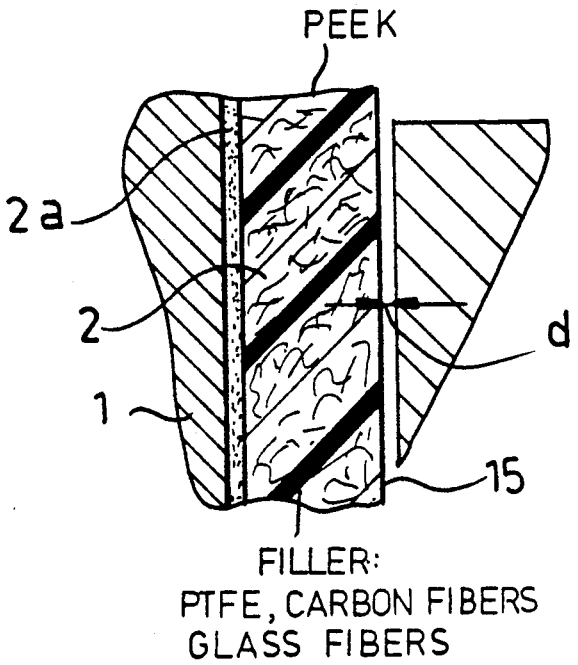
FIG. 3 is a diagram illustrating this relationship drawn to still a larger scale.

As is apparent from FIG. 3, the cylinder bushing 2 is cemented via an adhesive layer 2a in the cylinder 1. The cylinder is closed by a cylinder head 3 forming part of a pump housing to be described in greater detail hereinafter.

In the cylinder bushing 2, a piston 4 of metallic material is radially reciprocatable. The piston 4 is urged by a compression spring 19 in the direction of its lower dead point position. The compression spring 14 holds the piston 4 against a piston guide shoe 5 and the piston guide shoe 5, in turn, against a respective eccentric 20. The piston guide shoe is also composed of a material which is a high-strength thermoplastic PEEK based synthetic resin.

The eccentric 20 forms part of an eccentric shaft 6.

On both sides of the eccentric 20, the eccentric shaft is journaled in one piece bearing shells 7, i.e. so-called slide bearing or plain bearing shells which are composed of high-strength thermoplastic PEEK based synthetic resin.

The bearing shells 7 journal the eccentric shaft in the eccentric shaft housing 8 which defines eccentric shaft compartment 14 surrounding the eccentric 20.

The piston 4 defines with the cylinder head 3 within the cylinder bushing 2 a cylinder chamber 13. Between the piston 4 and the cylinder bushing 2, an all-around clearance 15 is provided with a gap width d (FIG. 3) and a gap length 1 (FIG. 1).

In the region of the cylinder head 3, an intake valve 9 is provided, this valve being constituted as a ring 11 of the high-strength PEEK-based synthetic resin which overlies a plurality of passages 30 connected via a space 31 surrounding the cylinder 1 with the eccentric compartment 14. The eccentric compartment 14 is connected via a port 16 in a flange 32 affixed to the housing 8 by bolts 33 and connected with a source of the water to be pumped.

Also in the region of the cylinder head 3, an outlet valve 10 is provided which includes a valve member 12 of the high-strength thermoplastic PEEK based synthetic resin, the latter being biased into a closed position via a spring 34. The valve members 11 and 12 are actuated by pressure differential during the intake and displacement strokes of the piston 4.

The discharge valve 10 opens into a passage 35 in a cylinder-defining portion 37 of the housing which is affixed to the housing part 8 having the passages 38 communicating with a passage 39 in the flange 32 with which, in turn, an outlet 17 communicates. Ports 40 can represent connections to other cylinders angularly spaced about the eccentric shaft.

During the intake stroke of the piston 4, i.e. the stroke in which the piston is biased radially inwardly by its spring 19 as the eccentric shaft 6 is rotated, the pressure in the chamber 13 falls below the pressure in the compartment 14 and water passes via the passages 13 and the valve 9 into the chamber 13. During the compression stroke, i.e. the stroke during which the piston 40 displaced radially outwardly by the eccentric 20, the valve 9 is closed by the increased pressure in the chamber 13 and valve 10 is forced open to drive the water at high pressure to the outlet 17. The valve 10 is closed during the intake stroke and valve 9 is closed during the discharge stroke. The valve 10 opens when the water pressure in the cylinder chamber 13 exceeds a high-pressure threshold as mentioned previously. The piston 4 and the eccentric shaft 6 can be formed with passages 21 and cooling bores at which these passages open toward the sliding surfaces of the shoe 5 and the bearing shells 7 to effect cooling of these regions.

The ratio d:l should be 0.0005 to 0.0007, the gap width d should be such that approximately 0.0002 to 0.0003 volume percent of the water displaced by the pump passes through the gap 15 as cooling water to maintain the temperature of the bushing 2 below 50° C. The PEEK based material used can contain carbon fiber, PTFE, glass fiber, and/or mineral filler.

We claim:

1. A high-pressure water pump for practically lubricant-free water, comprising:

a housing defining an eccentric-shaft compartment, a cylinder and a cylinder head;

an eccentric shaft journaled in said housing and having an eccentric in said compartment;

a cylinder bushing composed of a high-strength polyetheretherketone thermoplastic synthetic resin in said cylinder;

a metal piston slidable in said cylinder bushing:

a piston-displacement shoe operatively connected to said piston and engaging said eccentric whereby said piston is reciprocated in said cylinder bushing upon rotation of said eccentric shaft; and intake and outlet valves enabling water to be drawn in an intake stroke of said piston into a cylinder chamber defined in said bushing between said head and said piston from said compartment and water to be driven from said pump at high pressure from said cylinder chamber in a discharge stroke of said piston, said piston defining an all-around clearance with said cylinder bushing through which a portion of water driven from said chamber is forced as a cooling medium, said all-around clearance having a gap width selected to define a minimum volume rate of flow of said cooling medium sufficient to maintain a maximum temperature of said cylinder bushing of 100° C. in continuous operation.

2. The high-pressure water pump defined in claim 1 wherein said cylinder bushing is composed of a filler-free high-strength polyetheretherketone.

3. The high-pressure water pump defined in claim 1 wherein said cylinder bushing is composed of a carbon-fiber filled high-strength polyetheretherketone thermoplastic synthetic resin.

4. The high-pressure water pump defined in claim 1 wherein said cylinder bushing is composed of a polytetrafluoroethylene-filled thermoplastic synthetic resin.

5. The high-pressure water pump defined in claim 1 wherein said cylinder bushing is composed of a carbon fiber and polytetrafluoroethylene-filled thermoplastic synthetic resin.

6. The high-pressure water pump defined in claim 1 wherein said cylinder bushing is composed of a glass-fiber filled or mineral-filled thermoplastic synthetic resin.

7. The high-pressure water pump defined in claim 1 wherein said high-strength polyetheretherketone thermoplastic synthetic resin has a hardness of at least 110 on the Rockwell "M" scale.

8. The high-pressure water pump defined in claim 1 wherein said high-strength polyetheretherketone thermoplastic synthetic resin has a thermal conductivity of at least 0.80 W/mK.

9. The high-pressure water pump defined in claim 1 wherein said cylinder bushing has a roughness of $R_z < 2.5$ μm and $> 1.5$ μm.

10. The high-pressure water pump defined in claim 1 wherein said cylinder bushing is adhesively bonded in said cylinder.

11. The high-pressure water pump defined in claim 1 wherein said all around clearance has a ratio of its gap width to its length at room temperature in a range of 0.0005 to 0.0007.

12. The high-pressure water pump defined in claim 1 wherein said gap width is selected so that the ratio of said flow of cooling medium to the volume of water drawn into said compartment is 0.0002% to 0.0003%.

13. The high-pressure water pump defined in claim 1 wherein said shoe is composed of a high-strength polyetheretherketone based thermoplastic synthetic resin material.

14. The high-pressure water pump defined in claim 1 wherein at least one of said valves comprises a valve closure member composed of a high-strength polyetheretherketone thermoplastic synthetic resin.

15. The high-pressure water pump defined in claim 1 wherein said eccentric shaft is journaled in slide bearings in said housing having slide bearing shells enclosing said shaft and composed of high-strength polyetheretherketone thermoplastic synthetic resin.

16. The high-pressure water pump defined in claim 1 wherein a plurality of such cylinders is provided in said housing in a row.

17. The high-pressure water pump defined in claim 1 wherein a plurality of said cylinders is provided in said housing in a common radial plane.

* * * * *